US010655345B2

(12) United States Patent
Seow

(10) Patent No.: US 10,655,345 B2
(45) Date of Patent: May 19, 2020

(54) HEIGHT ACCESSIBLE WORKING PLATFORM WITH HORIZONTALLY DISPLACEABLE CRADLE

(71) Applicant: Tiong Bin Seow, Singapore (SG)

(72) Inventor: Tiong Bin Seow, Singapore (SG)

( * ) Notice: Subject to any disclaimer, the term of this patent is extended or adjusted under 35 U.S.C. 154(b) by 0 days.

(21) Appl. No.: 15/815,601

(22) Filed: Nov. 16, 2017

(65) Prior Publication Data

US 2019/0145110 A1 May 16, 2019

(51) Int. Cl.

| | |
|---|---|
| ***E04G 3/32*** | (2006.01) |
| ***B66F 11/04*** | (2006.01) |
| ***E04G 3/34*** | (2006.01) |
| *E04G 3/28* | (2006.01) |

(52) U.S. Cl.

CPC ..... *E04G 3/32* (2013.01); *B66F 11/042* (2013.01); *E04G 3/34* (2013.01); *E04G 2003/283* (2013.01); *E04G 2003/286* (2013.01)

(58) Field of Classification Search

CPC ..... B66F 11/042; E04G 2003/283; E04G 2003/286; E04G 3/035; E04G 1/36; E04G 3/30; E04G 3/24

USPC ..... 182/128

See application file for complete search history.

(56) References Cited

U.S. PATENT DOCUMENTS

| | | | | | |
|---|---|---|---|---|---|
| 2,927,705 | A * | 3/1960 | Girardi | A01D 46/20 | 182/2.11 |
| 3,306,396 | A * | 2/1967 | Goss | E04G 1/362 | 182/128 |
| 3,384,201 | A * | 5/1968 | Fulton | A01D 46/20 | 182/148 |
| 3,837,428 | A * | 9/1974 | Gish | E04G 3/30 | 182/129 |
| 3,994,365 | A * | 11/1976 | Petermann | B05B 13/06 | 182/2.1 |
| 5,018,923 | A * | 5/1991 | Melan | E04G 21/22 | 182/128 |
| 5,109,951 | A * | 5/1992 | Lecorre | B66F 11/044 | 182/141 |
| 2013/0240297 | A1 * | 9/2013 | Aquino | B66B 9/00 | 182/113 |

* cited by examiner

*Primary Examiner* — Alvin C Chin-Shue
(74) *Attorney, Agent, or Firm* — Sinorica, LLC

(57) ABSTRACT

The present disclosure relates to a height accessible working platform. The disclosed working platform generally comprises a frame attachable to a lifting system for being moveable along the vertical axis and suspended thereto; a cradle; a first arm structure having a proximal end terminated to the frame and an distal end attached to the cradle, the first arm structure being extendable and retractable to displace the cradle respectively away from and closer towards one of lateral sides of the frame along a first axis substantially perpendicular to the vertical axis; and a counterweight mechanism mounting at one lateral side of the frame opposing to the cradle, the counterweight mechanism being configured to balance the working platform corresponding to displacement of the cradle along the first axis.

11 Claims, 4 Drawing Sheets

HEIGHT ACCESSIBLE WORKING PLATFORM WITH HORIZONTALLY DISPLACEABLE CRADLE

TECHNICAL FIELD

The present disclosure relates to working platform usable for height access through lifting action performed by hoisting or winch assembly, which can be either installed to a stationary location of a building or on a mobile unit. More specifically, the disclosed working platform is equipped with features allowing part of the platform to move horizontally in addition to vertical movement for accessing a location at a given height.

BACKGROUND

Height accessible working platforms or working gondolas are generally installed and suspended at high rise building for workers to carry out activities in maintaining the facade of the building. Preferably, the working platform is coupled to one or more support arms and a hoisting assembly through one or more mechanically strong cables that extension or retraction of which descends or ascends the working platform, allowing the workers to access different location vertically on the facade of the building. Despite capable of facilitating work efficiently at the vertical axis, horizontal access to the building facade has been greatly restrictive by the width of the working platform. To shift the working platform in a horizontal direction, the working platform has to be rested on the ground or retrieved to the rooftop followed by relocation of the support and hoisting assembly. It is possible to improve horizontal access with utilization of tools with lengthened handle, such practice is far from ideal and the working efficiency attained thereof cannot be considered satisfactory at all.

To overcome limitations imposed, improvement has been made to realize the horizontal movement or displacement of such working platform. For instance, European patent application no. 94104478.6 discloses a height access system with a working gondola suspended from a track which permits horizontal movement of the suspending working gondola. Similar approach is implemented in U.S. Pat. No. 4,811,819 with the rails for horizontal moving of the working platform being fashioned to be detachable from rail supporting portion established on the roof of the building. Nonetheless, installation of the rail or track effectuating the horizontal movement can be very costly and requires sufficient space on the roof of the building for setting up the rails. Kumana adopted another solution to approach the like limitations in U.S. Pat. No. 5,343,979. Particularly, in Kumana's disclosure, the system has the gondola respectively angularly secured to two distantly spaced powered winches via two different pairs of ropes that one rope of each paired ropes is fastened to a pivotally moveable T-shaped suspender. Winding the two pairs of ropes adjustably positions the attached gondola vertically and horizontally. However, attempt to move the gondola horizontally may appear more difficult in the system of Kumana when the distance between the gondola and the powered winches becomes shorter. Therefore, working platform or gondola with improved and/or simplified mechanism for effectuating horizontal movement is highly desired.

SUMMARY

The present disclosure aims to provide a working platform or working gondola usable for height access. The disclosed working platform can be coupled to davit arm or any other supportive structures established on rooftop of a building to attain the required height. Notwithstanding that, the disclosed working platform can be lifted to the desired height by a mobile lifting vehicle known in the field.

Another object of the present disclosure is directed to a working platform featuring the capacity of horizontal displacing part of the platform that it permits the user to approach a range of horizontal distance without the need of relocating the rooftop supportive structure or mobile lifting vehicle connecting to the working platform.

Further object of the present disclosure is set out to disclose a working platform capable to provide access towards a location remotely and horizontally distanced away free from requiring any rails, tracks or ropes affixed to a structure besides the working platform. More specifically, the working platform houses all the necessary parts and/or mechanism to effectuate the horizontal displacement. It requires no other parts or mechanisms constructed on external structures or buildings to achieve the horizontal displacement.

At least one of the preceding objects is met, in whole or in part, by the present disclosure, in which some of the embodiments of the present invention relate to a height accessible working platform comprising a frame attachable to a lifting system for being moveable along the vertical axis and suspended thereto; a cradle; a first arm structure having a proximal end terminated to the frame and an distal end attached to the cradle, the first arm structure being extendable and retractable to displace the cradle respectively away from and closer towards one of lateral sides of the frame along a first axis substantially perpendicular to the vertical axis; and a counterweight mechanism mounting at one lateral side of the frame opposing to the cradle. Preferably, the counterweight mechanism is configured to balance the working platform corresponding to displacement of the cradle along the first axis.

For a number of embodiments, the working platform further comprises a first guide located on the frame; and a cable being routed through the first guide for attaching onto the distal end of the first arm structure to impart a tension force to the first arm structure. The tension force exerted ensure that the whole suspending working platform remains balance and stabilized in the event of extension or retraction of the cradle in relation to the frame of the platform. In few embodiments, the first guide is located at a position on the frame relatively higher than the first arm structure such that the routed cable form an acute angle with the first arm structure at the distal end.

According to several embodiments, the working platform may further include a first guide located on the frame and a second guide secured to the first arm structure; and a cable being routed through the first guide and second guide for attaching onto the distal end of the first arm structure to constantly impart a tension force to the first arm structure. Preferably, the portion of cable running between the first and second guides forms an acute angle in relation to the first axis. On the other hand, the portion of cable located between the second guide and the distal end of the first arm structure extends in a fashion parallel to the first axis.

For a plurality of embodiments, a powered hoist is carried by the frame to actuate the first arm structure to extend or retract in relation to the frame. The actuation or displacement of the first arm structure can be controlled, adjusted, managed or maneuvered by a control panel installed at the cradle.

In more embodiments, the counterweight mechanism in the disclosed platform comprises a counter load; and a second arm structure having a proximal end terminated to the frame and an distal end attached to the counter load, the second arm structure being extendable and retractable to displace the counter load respectively away from and closer towards the frame along a first axis substantially perpendicular to the vertical axis, the second arm structure being configured to displace the counter load along the first axis at a second distance corresponding to a load at the cradle and/or a relative first distance of the cradle away from the frame in manner to free the platform from tilting. For some embodiments, the counter load has adjustable weight.

Further embodiments of the disclosed working platform, the counterweight mechanism comprises a powered winch mounted to the frame; a roller guide located away from the frame and the winch; a rope, at least partly housed in or reeled to the winch, having one fixed end secured to the winch and a free end stretching away from the winch to route through the roller guide to be fastened to an anchorage point, the rope being tightened to generate a tension force thereto by the winch to free the platform from tilting that the tension force generated corresponds to a load at the cradle and/or a relative first distance of the cradle away from the frame.

In a number of embodiments, the counterweight mechanism of the working platform may comprise a powered winch mounted to the frame; a roller guide located away from the frame and the winch; a rope, at least partly housed in the winch, having one fixed end secured to the winch and a free end stretching away from the winch to route through the roller guide to be fastened to counter load. Further, the counter load is displaceable from the frame by the winch at a second distance to generate a tension force thereto to free the platform from tilting that the tension force generated corresponds to a load at the cradle and/or a relative first distance of the cradle away from the frame.

For few embodiments, the frame comprises a plurality roller wheels rendering the disclosed platform glidably moveable across a substantially even surface.

Another aspect of the present disclosure involves a height accessible system, preferably for a building. The system comprises a powered hoisting assembly installed around rooftop of the building; a frame attached to the hoisting assembly for being moveable along the vertical axis and suspended thereto in front of façade of the building; a cradle; a first arm structure having a proximal end terminated to the frame and an distal end attached to the cradle, the first arm structure being extendable and retractable to displace the cradle respectively away from and closer towards one of lateral sides of the frame along a first axis substantially perpendicular to the vertical axis; a counterweight mechanism mounting at one lateral side of the frame opposing to the cradle, the counterweight mechanism being configured to balance the working platform corresponding to displacement of the cradle along the first axis; a first guide located on the frame; and a cable being routed through the first guide for attaching onto the distal end of the first arm structure to impart a tension force to the first arm structure.

Further embodiments of the disclosed system have the counterweight mechanism included a counter load; and a second arm structure having a proximal end terminated to the frame and an distal end attached to the counter load. Preferably, the second arm structure is extendable and retractable to displace the counter load respectively away from and closer towards the frame along a first axis substantially perpendicular to the vertical axis. The second arm structure being configured to displace the counter load along the first axis at a second distance corresponding to a load at the cradle and/or a relative first distance of the cradle away from the frame in manner to free the platform from tilting.

DETAILED DESCRIPTION

For the purpose of facilitating an understanding of the invention, there is illustrated in the accompanying drawing the preferred embodiments from an inspection of which when considered in connection with the following description, the invention, its construction and operation and many of its advantages would be readily understood and appreciated.

The directional term such as "top", "bottom", "parallel", "side", "perpendicular", "distal" and "proximal" used throughout herein the specification generally refers to the relative direction of the described preferred embodiments with regard to the relative positions of the various elements of the described working platform when it is put to use.

Figure 1:
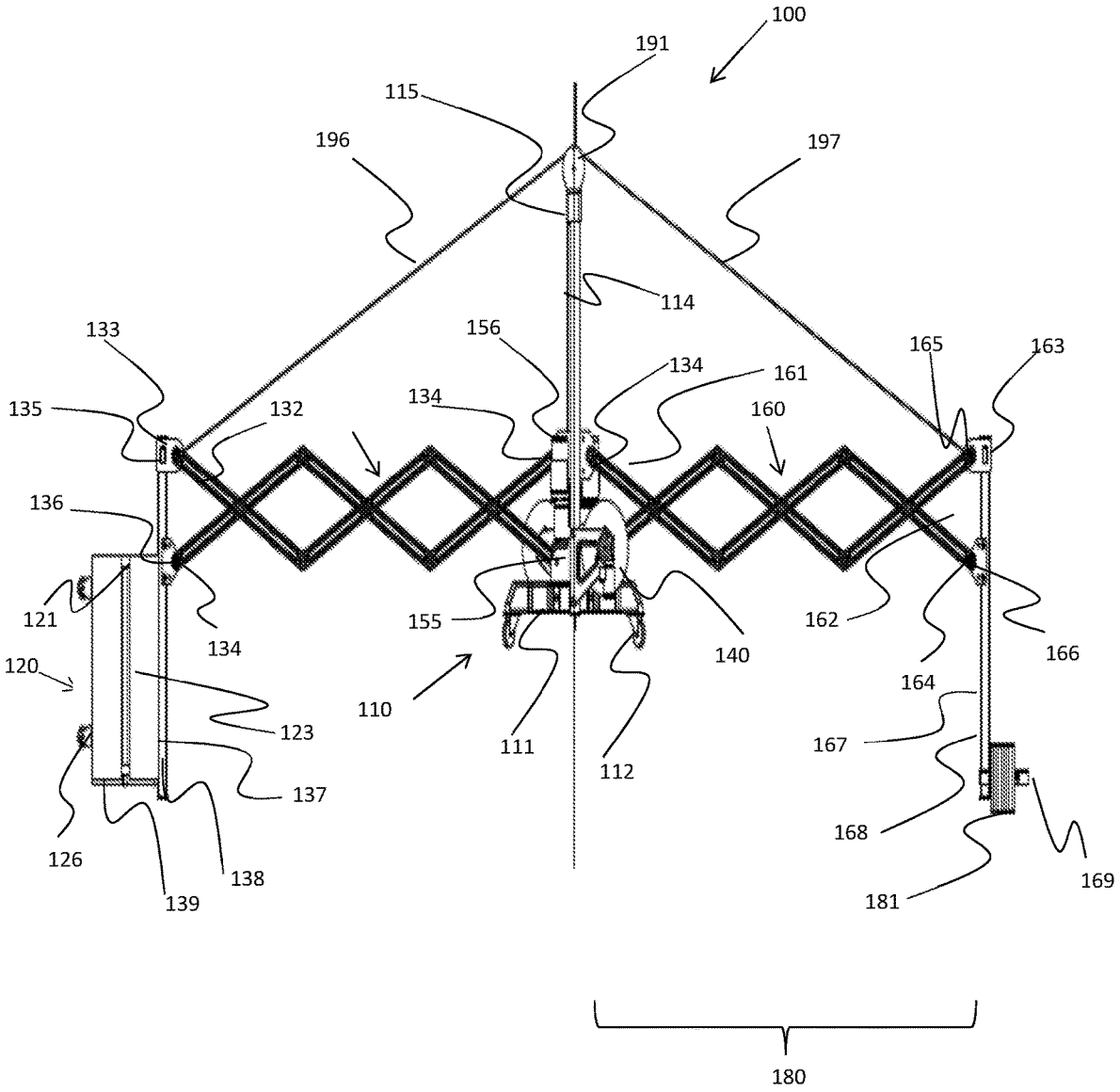
FIG. 1 illustrates one embodiment of the disclosed working platform with both first and second arm structure being extendable scissors arms.
Figure 2:
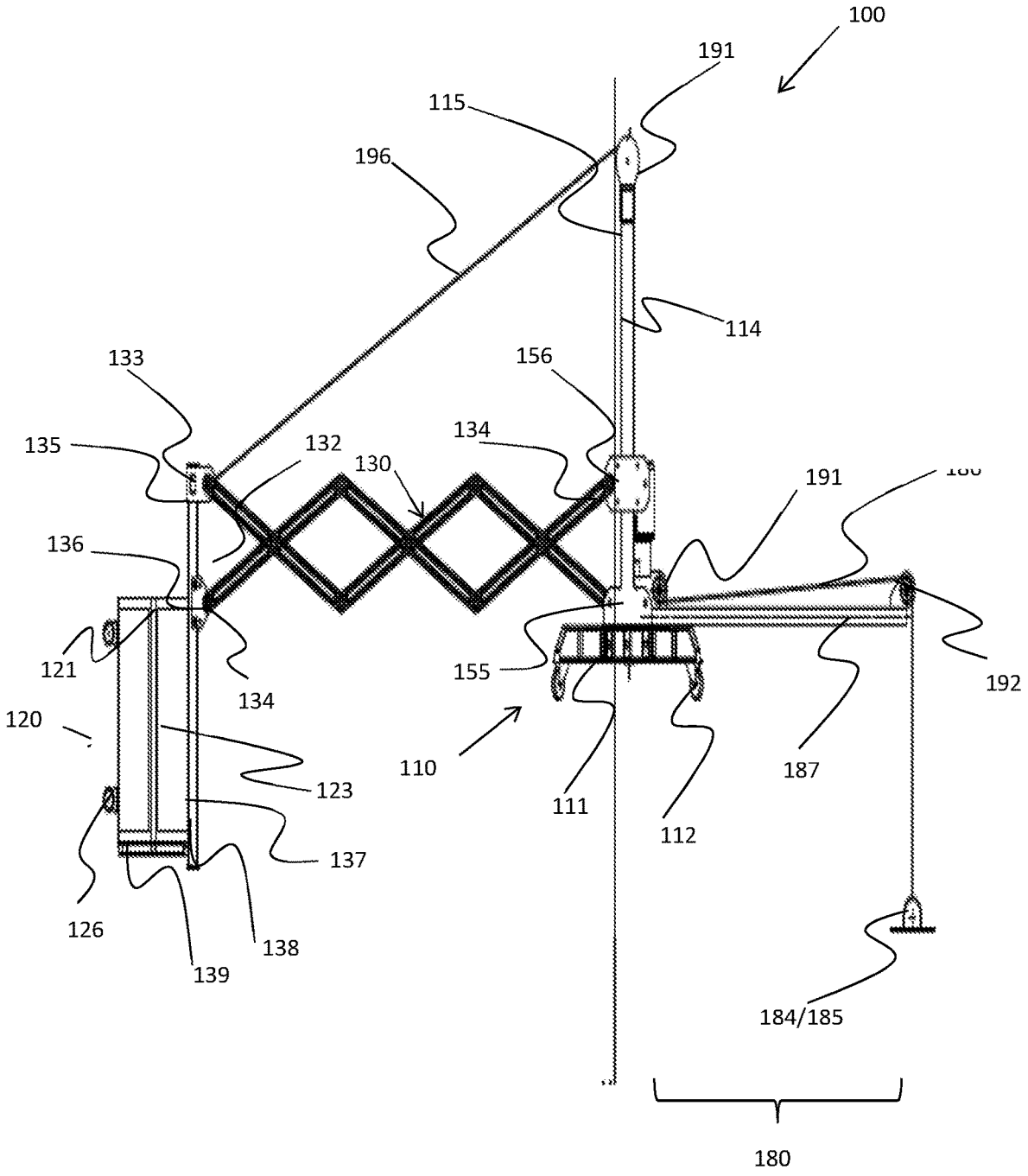
FIG. 2 illustrates another embodiment in which the counterweight mechanism employs a cable routed through a roller guide and secured to an anchor point or a counter weight for stabilizing the platform.
Figure 3:
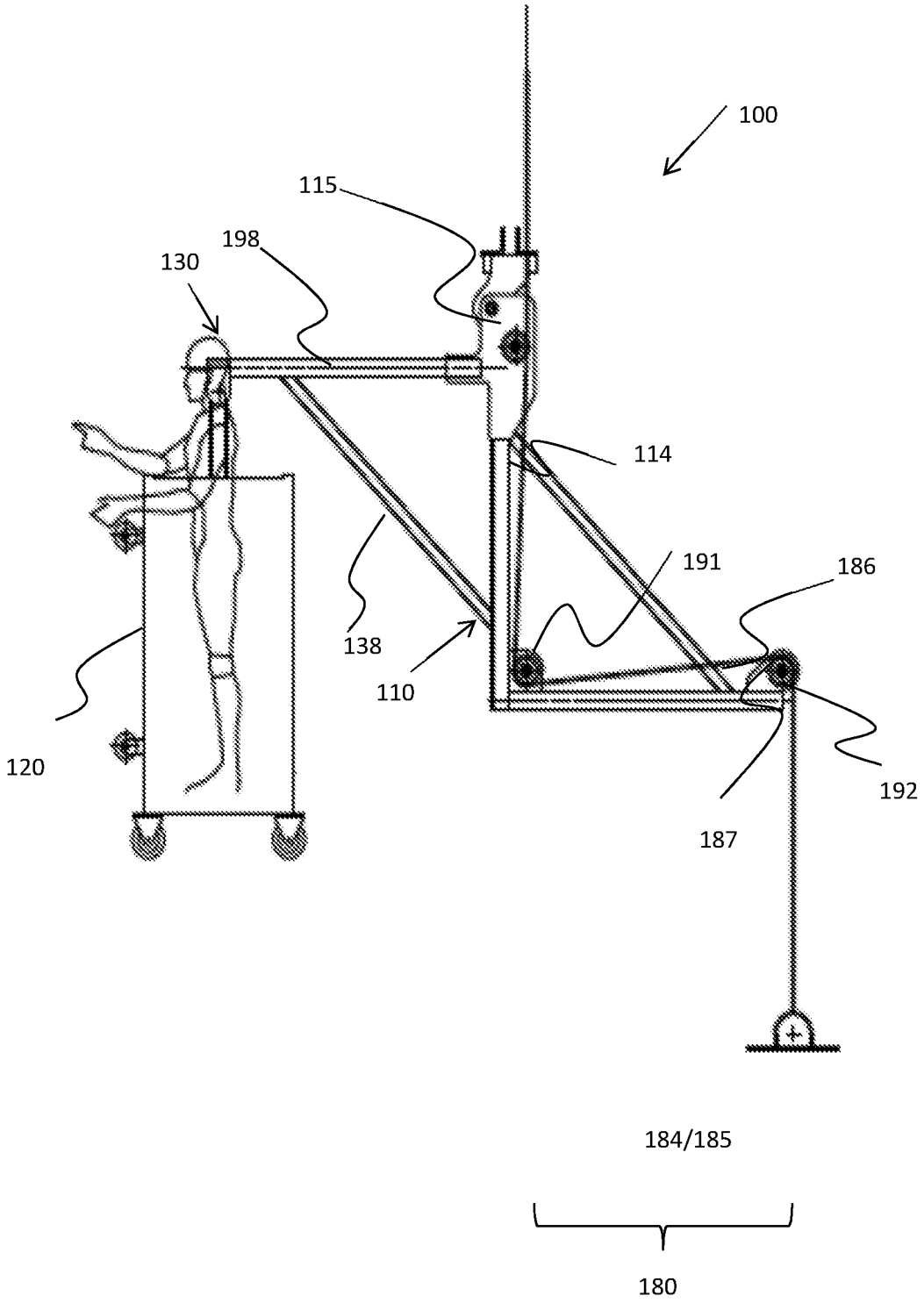
FIG. 3 shows another embodiment in which the first arm structure is a telescopically extendable pole or shaft.

According to one aspect of the present disclosure, a height accessible working platform 100 or working gondola is disclosed. Preferably, the working platform 100, as shown in FIG. 1-3, comprises a frame 110 attachable to a lifting system for being moveable along the vertical axis and suspended thereto; a cradle 120; a first arm structure 130 having a proximal end 131 terminated to the frame 110 and an distal end 132 attached to the cradle 120, the first arm structure 130 being extendable and retractable to displace the cradle 120 respectively away from and closer towards one of lateral sides of the frame 110 along a first axis substantially perpendicular to the vertical axis; and a counterweight mechanism 180 mounting at one lateral side of the frame 110 opposing to the cradle 120. Preferably, the counterweight mechanism 180 is configured to balance the working platform 100 corresponding to displacement of the cradle 120 along the first axis.

Figure 4:
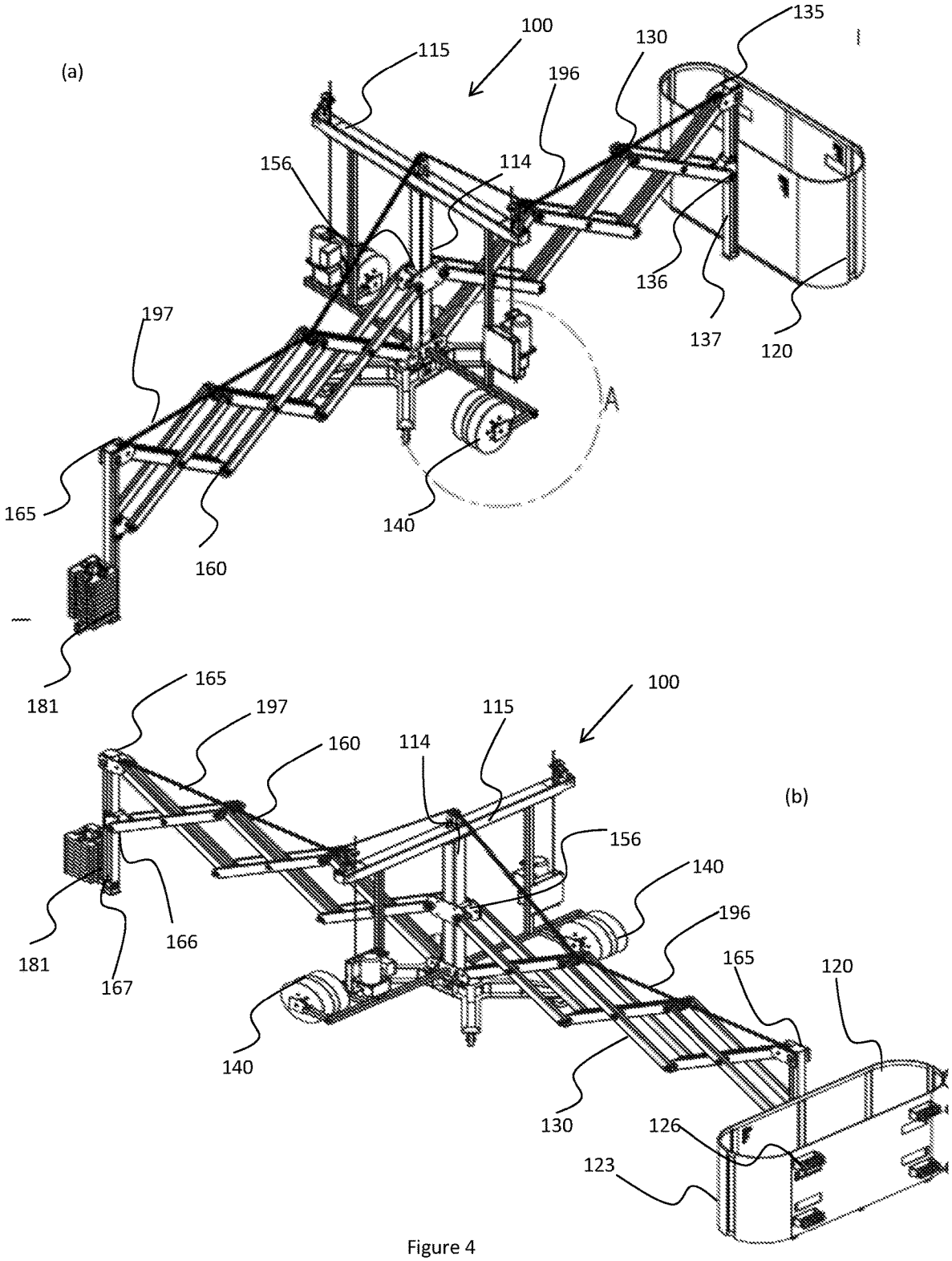
FIG. 4 shows perspective view (a) and (b) of one embodiment of the disclosed working platform with first and second arm structures attached to the frame.

For several embodiments, the frame 110 is fabricated from strong metal material such as steel, galvanized steel, hardened aluminum alloy or other metal alloys to withstand the weight of different structures being mounted directly or indirectly to the frame 110 and the weight of the workers as well as other tools loaded into the cradle 120. Particularly, the frame 110 has a bottom base 111 underneath of which several swivel wheels 112 have fixed to. With the aid of the swivel wheels 112, portability or mobility of the disclosed working platform 100 is greatly improved. User can push the disclosed platform 100 on a substantially floor surface to relocate the platform 100 when the need arises. To minimize the overall weight of the disclosed platform 100, the base 111 may, but not limited to, take the form of a cross base having four different bars spreading out horizontally out from the center of the base 111. One swivel wheel 112 attaches underside of the each bar around the extreme portion. Few embodiments of the disclosed working platform 100 may not have the swivel wheel 112 installed especially when such platform 100 is coupled to a stationary a davit or support arm for ascending or descending from one height level to another. The base 111 can be a plain metal slab in some embodiments for much simplified design. For more embodiments, the base 111 has one or more supportive structure 113, such as supportive column, erected from the base 111. The supportive structure 113 allows anchorage and securement of other components assembled to the disclosed platform 100. For instance, the supportive structure 113 is a T-shaped construct comprising a center pole 114 with one end mounted to the base 111 and an opposite end joined to a crossbar 115. As illustrated in FIG. 4, the disclosed platform 100 secures the first arm structure 130 to the center pole 114 and the cradle 120 indirectly joins the frame 110 through the first arm structure 130.

In some embodiments, the cradle 120 of the present disclosure is generally defined by an open top 121, a bottom 122 and sidewalls 123 spanning between the open top 121 and the bottom 122 enclosing a hollow space within the cradle 120. A structurally robust and rigid cradle 120 is critical to warrant greater safety for the user working on the disclosed platform 100 considering the weight of the user and tools to be loaded into the cradle 120. Therefore, the cradle 120, like the frame 110, is fabricated from light yet mechanically strong alloy or metal. More preferably, a plurality of longitudinally extending ribs are 125 fabricated on the sidewall 123 to reinforce overall structural integrity of the cradle 120. These embossed ribs 125 render the cradle 120 greater resistances against deformation or tearing. The hollow space enclosed in the cradle 120 is dedicated for housing the user of the platform 100 and accessible through the open top 121. Particularly, the user or worker moves into the cradle 120 prior to suspending the disclosed platform 100 and displacing the cradle 120 away from the frame 110 particularly for maintaining facade of a building. For a number of embodiments, part of the sidewalls 123 of the cradle 120 bears a plurality of wheels 126. Preferably, two pairs of wheels 126 are attached onto the part of sidewall 123 which is spaced furthest away from the frame 110; one pair of the wheels 126 are located around the open top 121 and another pair of wheels 126 are positioned closer to the bottom 122. More importantly, positions of the pairs of wheels 126 can be arranged differently according to the design of the disclosed embodiment as long the wheels 126 can equally sustain the weight or force loaded onto them and cradle 120 remains balance moving through a flat surface. The wheels 126 also facilitates vertical gliding movement of the cradle 120 on the façade of a building, it too serves as a stopper to prevent the cradle 120 from bumping onto the façade of the building directly when the cradle 120 is being displaced transversely toward the building. Length of cradle 120 preferably ranges from 90 to 150 cm such that the body lower part of the body of the user is encompassed by the sidewall 123 fencing the user from falling off the cradle 120. The bottom 122 of the cradle 120 may carry at least one through hole (not shown) for draining away fluid, such as rainwater, poured into the cradle 120 in few other embodiments of the disclosed platform 100.

As indicated above, the first arm structure 130 connects the cradle 120 to the frame 110. The first arm structure 130 can be collapsible scissor arms, telescopically extendable shafts or the like capable to realize horizontal or transverse displacement of the cradle 120 away or towards the frame 110. With reference to FIG. 4*a-b*, the first arm structure 130 takes the form of scissor arm having two opposite ends, the proximal end 131 and the distal end 132. As mentioned in the foregoing, the proximal end 131 attaches to the frame 110 while the distal end 132 secures the cradle 120. Each end has two separate anchorage tips, a fixed anchorage tip 133 and a displaceable anchorage tip 134, pivotally coupled to the frame 110 or the cradle 120. In connection to the extension and retraction of the scissor arm to displace the cradle 120, the relative distance between the two anchorage tips 133, 134 changes. More specifically, the displaceable anchorage tip 134 is drawn closer to the fixed anchorage tip 133 in line with extension motion of the scissor arm. On the other hand, the relative distance of the two anchorage tips 133, 134 becomes greater when the distal end 132 is brought closer to the proximal end 131 in conjunction with retraction of the scissor arm. In order to accommodate changes, the fixed anchorage tip 133 in some embodiments pivotally connects to the frame 110 through a fixed hinge member 155 fastened to the center pole 114 and rested on top of the base 111 of the frame 110. The displaceable anchorage tip 134 of the first arm structure 130 is pivotally joined to a displaceable hinge member 136, which is slidable or displaceable along the center pole 114 corresponding to the extension or retraction of the first arm structure 130. Substantially similar arrangement can be found around the distal end 132 of the first arm structure 130. Specifically, the disclosed platform 100 employs a construct 138 to facilitate attachment of the first arm structure 130 to the cradle 120 and materializing the sliding movement of the displaceable anchorage tip 134 at the distal end 132. Preferably, the construct 138 can adapt a L-shaped construct, in several embodiments, comprising a transverse bar 139 having one end joined to a longitudinal bar 137. The transverse bar 139 abuts and attaches to the bottom 122 of the cradle 120. Meanwhile, the longitudinal bar 139 attaches to the sidewall 123 of the cradle 120 erecting upward. Preferably, the free end of the longitudinal bar 139 outstretches the upper rim of the sidewalls 123. A fixed hinge member 135 mounts on or around the free end of the longitudinal bar for the fixed anchorage tip 133 of the scissor arm to pivotally lock onto, while a displaceable hinge member 136 is coupled to the displaceable anchorage tip 134 and slidably attaches to longitudinal bar. The longitudinal bar of the L-shaped construct functions as a track allowing the displaceable anchorage tip 134 of the distal end 132 to move in relation to the fixed anchorage tip 133, with the aid of the displaceable hinge member 136. For embodiment illustrated in FIG. 4*a-b*, the displaceable anchorage tips 134 of the proximal end 131 and the distal end 132 respectively ascend upward on the center pole 114 and descend downward through the construct 138 upon retracting the scissor arm. In accordance with more preferred embodiments, the frame 110 carries a powered hoist 140 to actuate or drive the first arm structure 130 to extend or retract in relation to the frame 110. In several embodiments, the powered hoist 140 may be configured to bring the anchorage tips 133, 134 at the proximal end 131 closer to one another resulting extension of the scissor arm and displacement of the cradle 120 away from the frame 110. Conversely, the powered hoist 140 pushes the displaceable anchorage tip 134 further apart from the fixed anchorage tip 133 leading to retraction of the first arm structure 130 and pulling the cradle 120 closer to the frame 110. Other embodiments as presented in the FIG. 3 utilize telescopically extensible and retractable shafts 198 to materialize horizontal displacement of the cradle 120. Gussets 139 may be used to attach the extensible shaft 198 to the frame 110 reinforcing the structural integrity shaft. The telescopically collapsible shafts 198 in such embodiments can be driven through, but not limited to, a hydraulic system.

Pursuant to other embodiments of the present disclosure, the disclosed platform 100 is equipped with the counterweight mechanism 180 to retain stability of the whole platform 100 especially when the first arm structure 130 pulls or pushes the cradle 120 for transverse displacement at the horizontal plan. The counterweight mechanism 180 is fashioned to prevent the disclosed platform 100 from tilting or skewing off that can cause unnecessary danger to the user staying in the cradle 120. Embodiments illustrated in FIGS. 1 and 4 reveal one possible implementation of the counterweight mechanism 180. The counterweight mechanism 180 comprises a counter load 181; and a second arm structure 160 having a proximal end 161 terminated to the frame 110 and a distal end 162 attached to the counter load 181. Preferably, the second arm structure 160 is extendable and retractable to displace the counter load 181 respectively away from and closer towards the frame 110 along a first axis substantially perpendicular to the vertical axis. The second arm structure 160 is further configured to displace the counter load 181 along the first axis at a second distance corresponding to a load at the cradle 120 and/or a relative first distance of the cradle 120 away from the frame 110 in manner coping potential titling of the platform 100. As shown, the second arm structure 160 can be an extensible scissor arm like its counterpart, the first arm structure 130, in several embodiments. The second arm structure 160, in the form of scissor arm, has two opposite end, the distal end 162 at which the counter load 181 fastens to and the proximal end 161 being secured to the frame 110. Each end carries a fixed anchorage 163 tip and a displaceable anchorage tip 164 with a distance spaced in between the tips 163,164 that the distance changes in an inverse proportion manner corresponding to the total length of the scissor arm. The distance of the two tips 163, 164 appears shorter when the second arm structure 160 becomes extended and vice versa. With the utilization of scissor arm as the second arm structure 160 in the counterweight mechanism 180, rail member 168 or track member is incorporated into the disclosed platform 100 to facilitate displacement of the displaceable anchorage tip 164 in relation to the fixed anchorage tip 163. In a number of embodiments, the fixed anchorage tip 163 of the second arm structure 160 pivotally shares the fixed hinge member 155 connected to the fixed anchorage tip 133 of the first arm structure 130 too, but at a position on the fixed hinge member 155 substantially opposite to the position at which the first arm structure 130 has been secured to. The scissor arm of the second arm structure 160 has the displaceable anchorage tip 164 of the proximal end 161 mounted to the center pole 114 of the frame 110 via the displaceable hinge member 156; the displaceable hinge member 156 is concurrently joined to the displaceable anchorage tip 133 of the first arm structure 130 at the proximal end 131 too. Preferably, the scissor arm of the first 130 and second arm structures 160 are similar in terms physical properties like shape and size such that the extension or retraction of both first 130 and arm structures 130,160 in these embodiments can be synchronized by way of adjusting relative position of the shared displaceable hinge member 156 along the center pole 114. The center pole 114 serves as a rail or track member for the displaceable hinge member 155 around the proximal end 161 of the arm structures 130, 160 to slide along. Notwithstanding that, the disclosed platform 100 may adaptably use other form of the rail or track member. For instance, the track member can be a vertically extending groove fabricated on the frame 110; the engagement of the displaceable anchorage tip 133,163 of the first 130 and/or second arm structure 160 to the groove can be optionally realized using the displaceable hinge member. Still, the extension or retraction of the first 130 and second arm structures 160 is independent of one another in a number of embodiments. According to these embodiments, the displaceable hinge member on the frame 110 is not shared, but rather each arm structure independently couples to the frame 110 individually with or without the use of the displaceable hinge member.

In accordance with several embodiments, the distal end 162 of the scissor arm of the second arm structure 160 bears the counter load 181. The distal end 162 of the second arm structure 160 may be provided with a construct 168, preferably an L-shaped construct substantially similar to the like construct fixed to the first arm structure 130, for holding the counter load 181. The construct 168 is directed to hold the counter load 181 and/or present a gliding track for sliding movement of the displaceable anchorage tip at the distal end 162 of the second arm. The construct 168 substantially machined to be L-shaped comprises a transverse bar having one end joined to a longitudinal bar 167 at the right angle. Preferably, the disclosed platform 100 has the counter load 181 hung on the transverse bar 169 to counteract on the load in the cradle 120 for stabilizing the whole platform 100 throughout its operation. The counter load 181 may possess adjustable weight in some embodiments in which the counter load 181 of various weights and/or sizes can be detachably hung to the transverse bar 169 corresponding to the load in the cradle 120. A simple fastening mechanism can be found on the construct 168. The fastening mechanism permits the counter weight to be removably secured on the construct 168. Furthermore, the displaceable anchorage tip 164 of the scissor arm, as the second arm structure 160, engages to the longitudinal bar 167 of the construct 168 through the displaceable hinge member 166 disposed thereto. Through the displaceable hinge member 166, the disclosed platform 100 renders the displaceable anchorage tip 164 slidable corresponding to extension or retraction of the second arm structure 160. The construct 168 is irremovably equipped with a fixed hinged member 165 to couple with the fixed anchorage tip 163 of the second arm structure 160. The fixed hinged member 165 is preferably located at a position relatively higher than the displaceable hinge member 166 on the construct 168. It is important to note that the construct 168 of any preferably shape and size may be carved with one or more grooves for accommodating sliding movement of the anchorage tips 165, first 130 and/or second arm structures 160, with or without presence of the displaceable hinge member. The displaceable hinge member may include one or more rollers to achieve sliding motion within the groove.

Further to the foregoing description, the second distance attained by the second arm structure 160 corresponds or substantially corresponds to the load on the cradle 120 and/or the first distance spacing the cradle 120 away from the frame 110 in some disclosed embodiments. For example, the second arm structure 160 may push the counter load 181 apart from the frame 110 at the second distance which is similar or almost similar to the first distance when the weight difference of the load and the counter load 181 are minimal or within an acceptable limit. The acceptable limit can be around 0.1 to 50%, but not limited to, weight differences between the load and the counter load 181. In other embodiments, the second distance can be longer or shorter than the first distance that the displaceable anchorage tips of the first 130 and second arm structure 160 are slidably mounted to the frame 110 independently. The second arm structure 160 may have the counter load 181 reached out for a distance longer than the first distance in the situation where the load on the cradle 120 is significantly higher than the counter load 181. The extra distance acquired by the second arm structure 160 imparts greater force to the counterweight mechanism 180 to counterbalance the force yielded by the additional load found on the cradle 120, and vice versa.

For several embodiments, the counterweight mechanism 180 adaptably implements another approach to balance or stabilize the platform 100. In general, the counterweight mechanism 180 comprises a powered winch 182 mounted to the frame 110; a roller guide 183 located away from the frame 110 and the winch 182; a rope 186, at least partly housed in the winch 182, having one fixed end secured to the winch and a free end stretching away from the winch to route through the roller guide to be fastened 199 to an anchorage point 184. Preferably, the winch 182 is set to tighten the rope 186 to generate a tension force thereto to free the platform 100 from tilting. The tension force generated or imparted to the platform 100 corresponds to a load at the cradle 120 and/or a relative first distance of the cradle 120 plus load away from the frame 110. In more particular, the counterweight mechanism 180 of these embodiments may include an elongate or planar segment 187 projecting out from the frame 110 in a direction opposite to the direction at which the first arm structure 130 extends to. Shown in FIG. 3, the segment 187 expands on a plane parallel to the base 111 of the frame 110. The segment 187 has one extreme anchored to the frame 110 and another pending extreme projecting away from the frame 110. The roller guide 183 is installed preferably around the pending extreme, more preferably on the top surface of the segment 187. The rope 186 runs across and on top of the segment 187 to be routed through the roller guide 183 positioned on the pending extreme of the segment 187. The rope 186 further has the free end attached to the anchorage point 184 located at a height level preferably lower than the suspended platform 100. The rope 186 becomes progressively tightened or loosened corresponding to the load and the first distance ranging between the cradle 120 and the frame 110. Specifically, the winch 182 is designed to pull the rope 186 at greater force when there is higher load in the cradle 120 and/or the cradle 120 is pushed further from the frame 110. The pulling force from the winch 182 may be reduced for lower load in the cradle 120 and/or shorter distance spacing the cradle 120 from the frame 110. The rope 186 is constantly tightened or imparted with a tension force throughout operation or the use of the disclosed platform 100. The pulling or loosening of the rope 186 can be manually controlled by the user in few embodiments. More preferably, in other embodiments, the winch 182 is in communication with a sensor (not shown), which is configured to detect tilting of the disclosed platform 100, through an electronic circuit connecting to the winch 182 as well. The sensor can be a tilt or axial sensor. The sensor automatically prompts the winch 182 to gradually tighten or loosen to rope to act against any detected tilting of the platform 100.

In more embodiments, the counterweight mechanism 180 carrying the powered winch 182 and the roller guide 183 may attach the free end 199 of the rope 186 to a counter load 185 instead of the fixed anchorage point. The counterweight mechanism 180 in these embodiments comprises the powered winch 182 mounted to the frame 110; the roller guide 183 located away from the frame 110 and the winch 182; and the rope 186, at least partly housed in the winch 182, having one fixed end secured to the winch 182 and a free end 199 stretching away from the winch 182 to route through the roller guide 183 to be fastened to counter load 181. To counterbalance the load on the cradle 120 and transverse movement of the loaded cradle 120, the counter load 185 is displaceable from the frame 110 by the winch 182 at a second distance to generate a tension force thereto to free the platform 100 from tilting. With reference to FIG. 3, the counterweight mechanism 180 utilizing the counter load 185, without the second arm structure, 160 may include also the elongate or planar segment 187 projecting out from the frame 110 in a direction opposite to the direction at which the first arm structure 130 extends to. The segment 187 has one extreme anchored to the frame 110 and another pending extreme projecting away from the frame 110. The roller guide 183 is installed preferably around the pending extreme. The rope 186 runs across and on top of the segment 187 to be routed through the roller guide 183 positioned on the pending extreme of the segment 187. The rope 186 further has the free end 199 attached to the counter load 185. Specifically, the winch 182 is fashioned to pull the counter load 185 closer to the frame 110 in connection to lighter load found in the cradle 120 and/or shorter first distance between the cradle 120 and the frame 110, and vice versa. The distance of the counter load 185 from the frame 110 or the second distance is proportional to the load in the cradle 120 and/or distance, or the first distance, of the loaded cradle 120 from the frame 110. By adjusting the relative distance between the counter load 185 and the frame 110, a tension force is generated or created on the disclosed platform 100 corresponds to and counterbalances the load at the cradle 120 and/or the relative first distance of the cradle 120 away from the frame 110.

Besides merely relying on the counterweight mechanism 180, the disclosed working platform 100 may offer another feature to attain greater stability for daily operation. An addition tensioning mechanism may be provided to channel persistent tension force towards the cradle 120. For a number of embodiments, the tensioning mechanism or the disclosed working platform 100 comprises a first guide 191 located on the frame 110; and a cable 196 being routed through the first guide 191 for attaching onto the distal end 132 of the first arm structure 130 to impart a tension force to the first arm structure 130. The cable 196 is preferably hooked to and driven by a secondary power winch (not shown), which can either be harbored by the frame 110 or remotely located. The present disclosure preferably has the secondary powered winch conditioned to continually drag the cable 196 and also the first arm structure 130 connected to the cable 196. The dragging or pulling force produced thereby shall be in a sufficient amount to yield the needed tension for the stability of the platform 100, but not to the extent which hinders transverse movement of the first arm structure 130. From FIGS. 1 and 2, one can see that the first guide 191 is located at a position on the frame 110 relatively higher than the first arm structure 130 such that the routed cable 196 form an acute angle with the first arm structure 130 at the distal end 132. For those embodiments having the counterweight mechanism 180 installed with the second arm structure 160, similar setting of the tensioning mechanism is implemented. Another cable 197, which is preferably drawn and reeled using a separate powered winch, runs through the first guide 191 towards the distal end 162 of the second arm structure 160 and attaches thereto. In a fashion alike the first arm structure 130, this cable 196 fastened to the second arm structure 160 introduces the necessary tension force to balance operation of the disclosed platform 100 in relation to the second arm structure 160. In more embodiments, the cable 196 may secure to the fixed hinge member 135, 165 on the constructs 138, 168 rather than directly attaches to the distal end 132/162 of the first 130 and/or second arm structure 160. Preferably, the cables 192 are made of metal or braided metal wires.

According to other embodiments of the disclosed platform 100, the tensioning mechanism can adaptably use a second guide 192 in addition to first guide 191 to further enhance stability of the disclosed platform 100. More particularly, at least second guide 192 mounts onto the first 130 and/or second arm structure 160, preferably on the topside or top edge, to receive the cable 196 guiding through and further directs the cable 196 towards the distal end 132/162 of the first 130 and/or second arm structure 160. The portion of the cable 196 spanning between the second guide 192 and the first guide 191 forms an acute angle with the horizontal plane, while the portion of the cables 196 stretching from the second guide 192 to the distal end 132/162 of the first 130 and/or second arm structure 160 is preferably in parallel with the horizontal axis. Particularly, the tensioning mechanism in these embodiments includes the first guide 191 located on the frame 110 and the second guide secured to the first 130 and/or second arm structure 160; and the cable 196 being routed through the first guide 191 and second guide 192 for attaching onto the distal end 132 of the first arm structure 130 to constantly impart a tension force to the first arm structure 130, the portion of cable running between the first 191 and second guides 192 forming an acute angle in relation to the first axis, the portion of cable 196 located between the second guide 192 and the distal end 132 of the first arm structure 130 extending in a fashion parallel to the first axis. For few embodiments, the second guide 192 can be integrated into one of the articulated joint, preferably located at the top side or edge, on the scissor arm of the first 130 and/or second arm structure 160. In further embodiments, one of the articulated joints of the scissor arm may be utilized to replace the second guide 192 for routing and guiding the cable 196 towards the distal end 132/162 of the first 130 and/or second arm structure 160. For example, the cable 192 may thread through a horizontally oriented through hole carved into the articulated joint extending forward to secure onto the distal end 132/162 of the first and/or second arm structure 160. The second guide 192 or the hole-bearing articulated joint provides an additional or secondary point of attachment, besides the distal end 132/162, for the cable 196 to impart sufficient tension force into the disclosed platform 100 for stabilizing at least the transverse movement of the cradle 120 and/or counter load 181.

Pursuant to another embodiment, the disclosed platform 100 may carry a control panel (not shown) installed on the cradle 120 for the user to control, adjust or regulate displacement of the cradle 120 along the first axis. Moreover, the described embodiment houses an integrated circuit for communicating at least with the control panel and the powered hoists 140 on the frame 110 being configured to drive or actuate horizontal extension or retraction of the first arm structure 130. Based upon user's input through the control panel, the first arm structure 130, likely in conjunction with the second arm structure 160 of the counterweight mechanism 180, extends or retracts to reach the desired spot on the facade of a building Another aspect of the present disclosed refers to a height accessible system, preferably for building maintenance, in which the setting forth working platform 100 or gondola is used. The disclosed system generally comprises a powered hoisting assembly installed around rooftop of the building; a frame 110 attached to the hoisting assembly for being moveable along the vertical axis and suspended thereto in front of façade of the building; a cradle 120; a first arm structure 130 having a proximal end 131 terminated to the frame 110 and an distal end 132 attached to the cradle 120, the first arm structure 130 being extendable and retractable to displace the cradle 120 respectively away from and closer towards one of lateral sides of the frame 110 along a first axis substantially perpendicular to the vertical axis; a counterweight mechanism 180 mounting at one lateral side of the frame 110 opposing to the cradle 120, the counterweight mechanism 180 being configured to balance the working platform 100 corresponding to displacement of the cradle 120 along the first axis. In a plurality of embodiments, the disclosed system includes tensioning mechanism equipped to bestow stabilization of the cradle 120 throughout the transverse movement or displacement. Preferably, in some embodiments of the mentioned system, the tensioning mechanism essentially comprises a first guide 191 located on the frame 110; and a cable 196 being routed through the first guide 191 for attaching onto the distal end 132 of the first arm structure 130 to impart a tension force to the first arm structure 130. As described in the foregoing, the cable 196 is preferably driven by a secondary power winch, which can either be installed to the frame 110 or remotely located at the rooftop of the building. The secondary powered winch is conditioned to continually drag the cable and also the first arm structure 130 connected to the cable. The dragging or pulling force produced thereby shall be in a sufficient amount to yield the needed tension for stabilizing the cradle 120 yet not hindering the transverse movement or displacement of the first arm structure 130. The first guide 191 is located at a position on the frame 110 relatively higher than the first arm structure 130 such that the routed cable 196 form an acute angle with the first arm structure 130 at the distal end 132. The first guide 191 may be positioned atop of the crossbar 115 of the frame 110.

For other embodiments of the disclosed height accessible system, the counterweight mechanism 180 basically includes a counter load 181; and a second arm structure 160 having a proximal end 161 terminated to the frame 110 and a distal end 162 attached to the counter load 181. It has been detailed in the foregoing that the second arm structure 160 of the counterweight mechanism 180, in several embodiments, is extendable and retractable in a fashion akin to the first arm structure 130 to displace the counter load 181 respectively away from and closer towards the frame 110 along the first axis which is substantially perpendicular to the vertical axis. Likewise, the second arm structure 160 is further configured to displace the counter load 181 along the first axis at a second distance corresponding to a load at the cradle 120 and/or a relative first distance of the cradle 120 away from the frame 110 in manner to free the cradle 120 from tilting in relation to the horizontal axis or plane. The second arm structure 160 can be an extensible scissor arm. The second arm structure 160, in the form of scissor arm, has two opposite end, the distal end 162 at which the counter load 181 fastens to and the proximal end 161 being secured to the frame 110.

The present invention may be embodied in other specific forms without departing from its structures, methods, or other essential characteristics as broadly described herein and claimed hereinafter. The described embodiments are to be considered in all respects only as illustrative, and not restrictive. The scope of the invention is, therefore, indicated by the appended claims, rather than by the foregoing description. All changes that come within the meaning and range of equivalency of the claims are to be embraced within their scope.

The invention claimed is:

1. A height accessible working platform comprising:

an elongated frame having a longitudinal axis attachable to a lifting system for being moveable along a vertical axis and suspended thereto;

a cradle;

a first arm structure having a proximal end terminated to the frame and an distal end attached to the cradle, the first arm structure being extendable and retractable to displace the cradle respectively away from and closer towards one of lateral sides of the frame only along a horizontal axis substantially perpendicular to the vertical axis and the longitudinal axis at a relative first distance of the cradle away from the frame; and a counterweight mechanism mounting at one lateral side of the frame opposing to the cradle, the counterweight mechanism comprising a counter load, a second arm structure having a proximal end terminated to the frame and a distal end attached to the counter load, the second arm structure being extendable and retractable to displace the counter load respectively away from and closer towards the frame along the horizontal axis, wherein the counterweight mechanism is configured to displace the counter load using the second arm structure along the horizontal axis at a second distance corresponding to a load at the cradle and/or a relative first distance of the cradle away from the frame in a manner to prevent the first arm structure and/or the cradle inclining away from the horizontal axis and/or the frame during extension or retraction of the first arm structure.

2. The working platform of claim 1 further comprising a first guide located on the frame; and a cable being routed through the first guide for attaching onto the distal end of the first arm structure to impart a tension force to the first arm structure.

3. The working platform of claim 2, wherein the first guide is located at a position on the frame relatively higher than the first arm structure such that the routed cable form an acute angle with the first arm structure at the distal end.

4. The working platform of claim 1 further comprising:

a first guide located on the frame and a second guide secured to the first arm structure; and a cable being routed through the first guide and second guide for attaching onto the distal end of the first arm structure to constantly impart a tension force to the first arm structure, the portion of cable running between the first and second guides forming an acute angle in relation to the horizontal axis, the portion of cable located between the second guide and the distal end of the first arm structure extending in a fashion parallel to the horizontal axis.

5. The working platform of claim 1 further comprising a powered hoist carried by the frame to actuate the first arm structure to extend or retract in relation to the frame.

6. The working platform of claim 1, wherein the counter load has adjustable weight.

7. The working platform of claim 1, wherein the second arm structure is an extendable scissors arm.

8. The working platform of claim 1, wherein the first arm structure is an extendable scissors arm.

9. The working platform of claim 1, wherein the frame comprises a plurality roller wheels for gliding the platform on a substantially even surface.

10. The working platform of claim 1 further comprising a control panel installed at the cradle for controlling displacement of the cradle along the horizontal axis.

11. A height accessible system for a building comprising:

a powered hoisting assembly installed around rooftop of the building;

a working platform comprising an elongated frame having a longitudinal axis attached to the hoisting assembly for being moveable along the vertical axis and suspended thereto in front of façade of the building;

a cradle;

a first arm structure having a proximal end terminated to the frame and an distal end attached to the cradle, the first arm structure being extendable and retractable to displace the cradle respectively away from and closer towards one of lateral sides of the frame only along a horizontal axis substantially perpendicular to the vertical axis and the longitudinal axis;

a counterweight mechanism mounting at one lateral side of the frame opposing to the cradle, the counterweight mechanism being configured to balance the working platform corresponding to displacement of the cradle along the horizontal axis;

a first guide located on the frame; and a cable being routed through the first guide for attaching onto the distal end of the first arm structure to impart a tension force to the first arm structure, wherein the counterweight mechanism is configured to prevent the first arm structure and/or the cradle inclining away from the horizontal axis and/or the frame during extension or retraction of the first arm structure, wherein the counterweight mechanism comprises: a counter load;

a second arm structure having a proximal end terminated to the frame and a distal end attached to the counter load, the second arm structure being extendable and retractable to displace the counter load respectively away from and closer towards the frame along the horizontal axis substantially perpendicular to the vertical axis, the second arm structure being configured to displace the counter load along the horizontal axis at a second distance corresponding to a load at the cradle and/or a relative first distance of the cradle away from the frame in manner to free the platform from tilting.

* * * * *